US010349730B2

(12) United States Patent
Ye

(10) Patent No.: US 10,349,730 B2
(45) Date of Patent: Jul. 16, 2019

(54) JUICER BRUSH

(71) Applicant: Hamilton Beach Brands, Inc., Glen Allen, VA (US)

(72) Inventor: Guoyao Ye, Glen Allen, VA (US)

(73) Assignee: Hamilton Beach Brands, Inc., Glen Allen, VA (US)

( * ) Notice: Subject to any disclaimer, the term of this patent is extended or adjusted under 35 U.S.C. 154(b) by 442 days.

(21) Appl. No.: 15/013,209

(22) Filed: Feb. 2, 2016

(65) Prior Publication Data

US 2016/0255947 A1 Sep. 8, 2016

Related U.S. Application Data

(60) Provisional application No. 62/129,309, filed on Mar. 6, 2015.

(51) Int. Cl.
*A46B 9/02* (2006.01)
*B08B 1/00* (2006.01)

(52) U.S. Cl.
CPC ..... *A46B 9/02* (2013.01); *B08B 1/002* (2013.01); *A46B 2200/3033* (2013.01)

(58) Field of Classification Search
CPC ..... A46B 5/0033; A46B 5/0041; A46B 9/02; A46B 2200/3033; A46B 7/02; B08B 1/002
USPC ..... 15/160, 185, 236.09
See application file for complete search history.

(56) References Cited

U.S. PATENT DOCUMENTS 1,607,448 A * 11/1926 Dykes ..... A46B 5/0033 15/185
1,777,516 A * 10/1930 Castle ..... A46B 5/0033 15/160
D159,469 S 8/1950 Bennett
2,989,765 A 6/1961 Gingrich
3,648,321 A 3/1972 Vallis
4,458,701 A * 7/1984 Holland ..... A45D 40/265 132/218
5,185,902 A 2/1993 Fong
5,257,575 A 11/1993 Harrison et al.
D375,816 S 11/1996 Long-Langworthy
5,704,088 A * 1/1998 Cerroni ..... B08B 1/00 15/160
D408,944 S 4/1999 Petschow
D470,306 S 2/2003 Halpern et al.
6,962,107 B1 11/2005 Yang
7,040,220 B1 5/2006 Cohen et al.
D526,540 S 8/2006 Cohen et al.
7,644,656 B2 1/2010 Esteve
7,854,194 B2 12/2010 Siu et al.
D634,126 S 3/2011 Viola
(Continued)

FOREIGN PATENT DOCUMENTS

JP 2005-318918 A * 11/2005 ..... A47J 19/00

*Primary Examiner* — Laura C Guidotti
(74) *Attorney, Agent, or Firm* — Alexander D. Raring

(57) ABSTRACT

A cleaning brush comprises a front curved wall and a rear curved wall. The front curved wall has a front surface and a back surface, with a plurality of frictional cleaning elements projecting from the back surface. The rear curved wall has a front surface and a back surface, with a plurality of frictional cleaning elements projecting from the front surface. The front and rear curved walls are hingedly affixed to each other and movable between an open position and a closed position.

18 Claims, 4 Drawing Sheets

(56) References Cited

U.S. PATENT DOCUMENTS

| | | | | |
|---|---|---|---|---|
| 8,210,101 | B2 | 7/2012 | Chang | |
| 8,474,375 | B2 | 7/2013 | Jays et al. | |
| 8,807,022 | B2 | 8/2014 | Backus | |
| 8,869,686 | B2 | 10/2014 | Backus | |
| D720,189 | S | 12/2014 | Lee | |
| 2007/0056450 | A1 | 3/2007 | Hensel | |
| 2008/0314261 | A1 | 12/2008 | Hensel | |
| 2011/0083565 | A1* | 4/2011 | Backus | A47J 19/027 99/511 |
| 2012/0031285 | A1 | 2/2012 | Pucher | |
| 2012/0192727 | A1 | 8/2012 | Wu | |
| 2017/0231414 | A1* | 8/2017 | Moon | A47J 19/02 99/492 |

* cited by examiner

JUICER BRUSH

CROSS-REFERENCE TO RELATED APPLICATIONS

This application claims priority to U.S. Provisional Patent Application Ser. No. 62/129,309, which was filed Mar. 6, 2015, the contents of which are incorporated herein by reference in its entirety.

FIELD OF THE INVENTION

The present invention relates generally to small appliances, and more particularly to juicers and tools for cleaning juicers.

BACKGROUND OF THE DISCLOSURE

A juicer is a small appliance that extracts juice from fruits and vegetables. There are two general types of juicers—centrifugal and masticating. Centrifugal juicers use a rapidly spinning cutter/strainer 10 within a housing of the juicer, such as is illustrated in FIG. 3. The spinning cutter/strainer 10 has a sloped mesh wall 12 and a circular floor 14, such that the cutter/strainer has a generally inverse frusto-conical shape. The floor 14 has a plurality of sharp teeth 16. As the cutter/strainer rapidly spins, the teeth 16 shred the food into a pulp, and centrifugal force pulls the juice out of the pulp and through the mesh wall 12, where it is funneled out of the juicer via a spigot. Once most of the juice has been extracted, the remaining pulp is ejected into a separate collection chamber.

The cutter/strainer is typically removable from the juicer housing for cleaning. However, even with the cutter/strainer removed from the housing, it is difficult to thoroughly clean the cutter/strainer, especially the mesh wall. Conventional scrub brushes are difficult to use with the frusto-conical shape of the cutter/strainer, as it is difficult to apply the necessary cleaning force while maintaining the brush in appropriate contact with the surfaces of the cutter/strainer that need to be scrubbed.

It has heretofore not been discovered how to create a cleaning brush for a centrifugal juicer that is capable of applying the necessary cleaning force while maintaining the brush in appropriate contact with the surfaces of the cutter/strainer that need to be scrubbed. The juicer brush of the following disclosure accomplishes the above and other objectives and overcomes at least the above-described disadvantages of conventional devices and methods for cleaning juicers.

BRIEF SUMMARY OF THE DISCLOSURE

A cleaning brush for cleaning a cutter/strainer of a centrifugal juicer is disclosed herein. In one embodiment of the subject appliance, the cleaning brush comprises a front curved wall having a front surface and a back surface, a plurality of frictional cleaning elements projecting from the back surface, and a rear curved wall having a front surface and a back surface, a plurality of frictional cleaning elements projecting from the front surface. The front and rear curved walls are hingedly affixed to each other and movable between an open position and a closed position. The curve of the front curved wall and the curve of the rear curved wall correspond such that the front and rear curved walls nest when the brush is in the closed position. The cleaning brush as disclosed herein allows for simultaneous cleaning of both sides of the cutter basket and further allows a user to apply pressure on the brush to increase the efficacy of the brush. As a result, a user is able to safely, quickly, and efficiently clean the appliance.

In addition to the cleaning brush, as described above, other embodiments of the disclosure are directed to methods for cleaning a cutter/strainer of a centrifugal juicer using the above-described cleaning brush.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
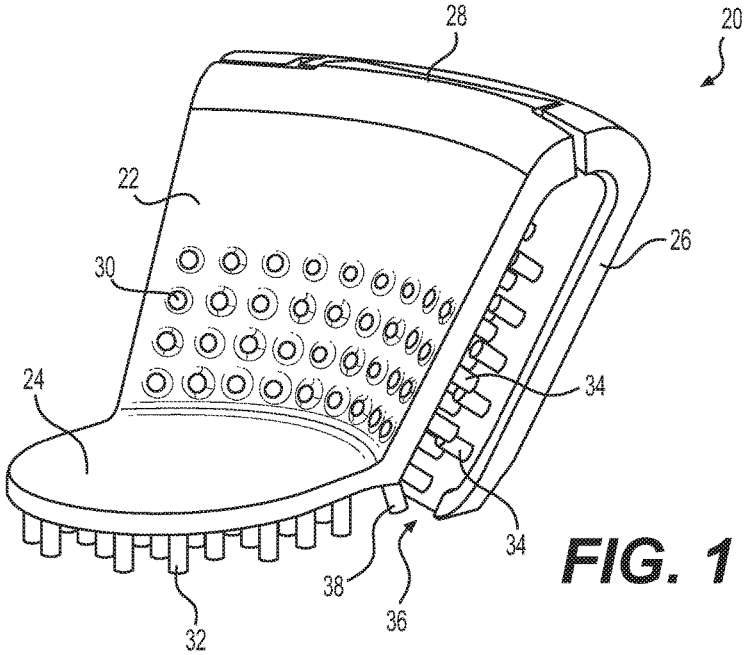
FIG. 1 is a perspective view from the front/top of a juicer brush in a closed position, according to one embodiment of the present disclosure.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout, FIGS. 1-10 illustrate a juicer brush 20 in accordance with a preferred embodiment of the present disclosure. Juicer brush 20 may be used, for example, to clean the cutter/strainer of a centrifugal juicer, as described herein.

Juicer brush 20 comprises a generally planar floor 24, a first wall 22 (which may also be termed a front wall) that is integral with or otherwise affixed to the floor 24 and that slopes upward and outward from the floor 24, and a second wall 26 (which may also be termed a rear wall) that is hingedly affixed to the first wall 22. The second wall 26 is hingedly affixed to the first wall 22 via hinge 28. The hinged affixation of the second wall 26 to the first wall 22 allows the second wall to hingedly move between (i) an open position (shown in FIG. 2) in which the brush 20 can be mated to or removed from the cutter/strainer 10 (and in which the brush itself can be more readily cleaned) and (ii) a closed position (shown in FIGS. 1 and 3-8) in which the brush 20 can scrub the cutter/strainer 10.

The first and second walls 22, 26 are curved, and have the same general curvature as the wall 12 of the cutter/strainer 10. As such, the first wall 22 and the second wall 26 are generally parallel to each other when the brush 20 is in the closed position, and the first wall 22 and the second wall 26 are generally parallel to the sloped wall 12 of the cutter/strainer 10 when the brush 20 is in the closed position and in position to clean the cutter/strainer. The floor 24 of the brush 20 is generally circular or rounded to correspond to the generally circular shape of the floor 14 of the cutter/strainer 10, although other shapes may be used. The angle between the floor 24 and the first wall 22 (and between the floor 24 and the second wall 26 when the brush is in the closed position) is generally the same as the angle between the floor 14 and the wall 12 of the cutter/strainer 10. As such, the floor 24 is generally parallel to the floor 14 of the cutter/strainer 10 and the first wall 22 and the second wall 26 are generally parallel to the sloped wall 12 of the cutter/strainer 10 when the brush 20 is in the closed position and in position to clean the cutter/strainer.

Figure 3:
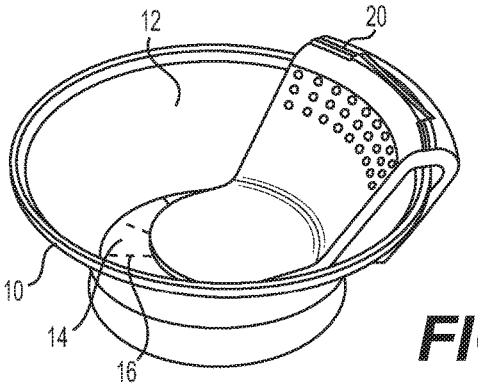
FIG. 3 is a perspective view of the juicer brush of FIG. 1, in position to clean a cutter/strainer of a centrifugal juicer.
Figure 4:
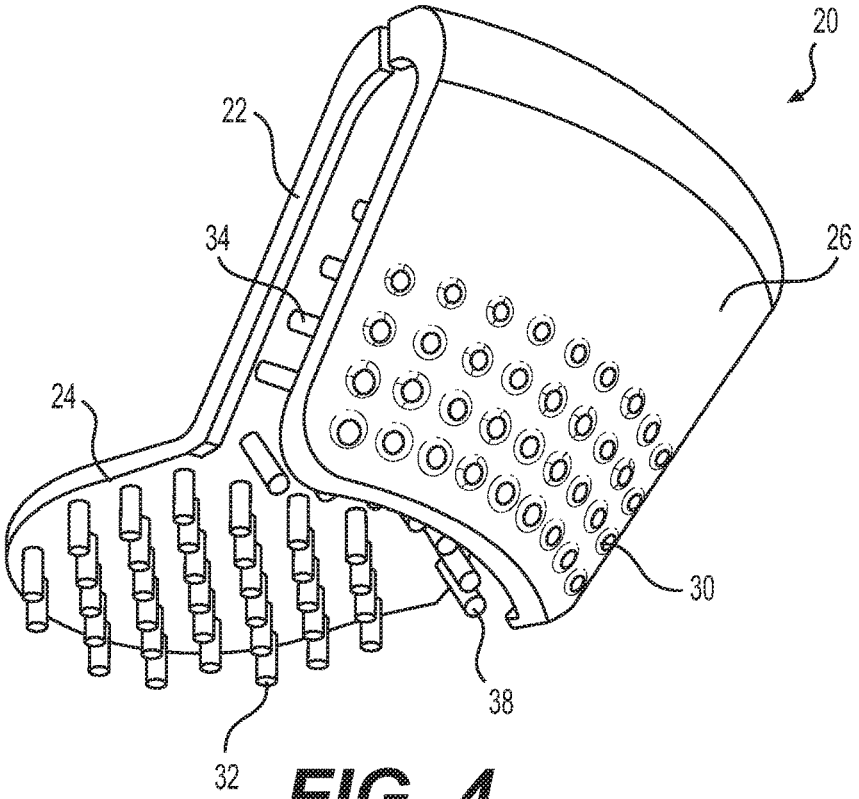
FIG. 4 is a perspective view from the rear/bottom of the juicer brush of FIG. 1, in a closed position.
Figure 5:
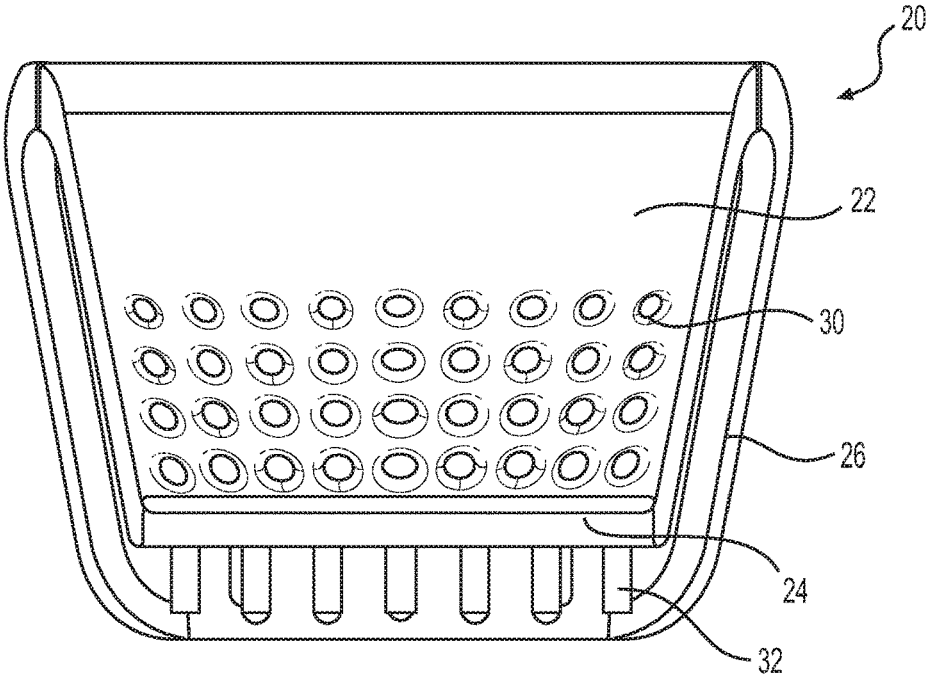
FIG. 5 is a front view of the juicer brush of FIG. 1, in a closed position.
Figure 6:
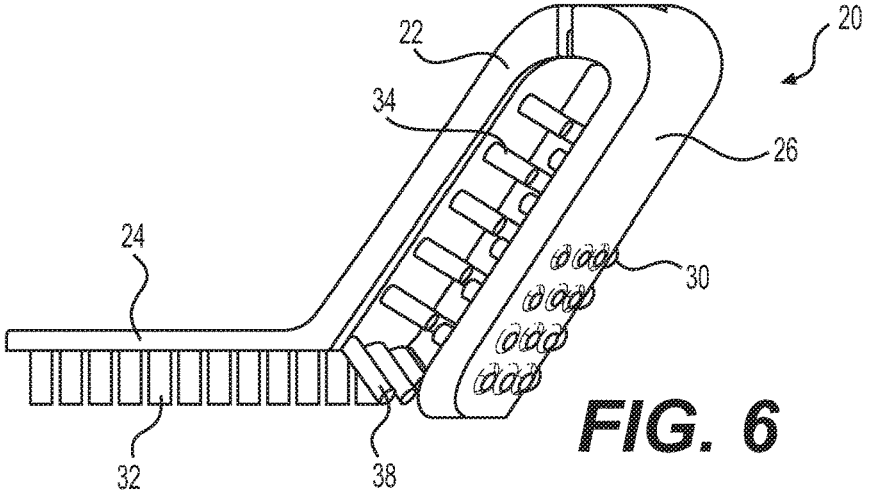
FIG. 6 is a side view of juicer brush of FIG. 1, in a closed position.
Figure 7:
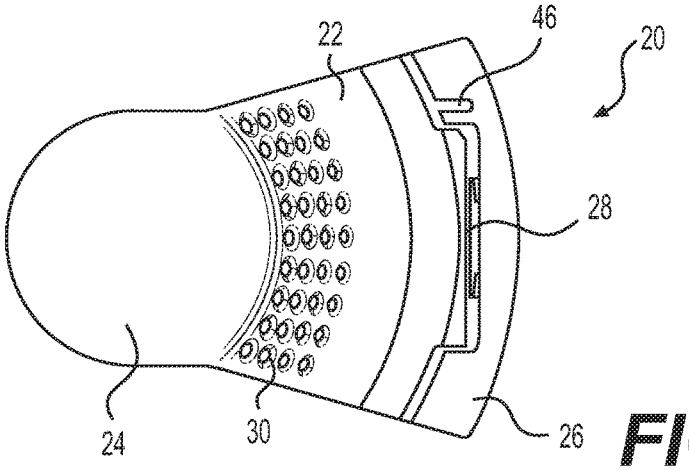
FIG. 7 is a top view of juicer brush of FIG. 1, in a closed position.
Figure 8:
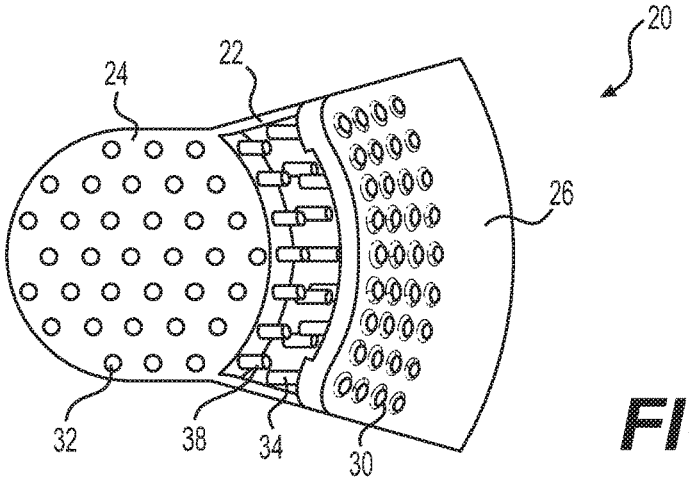
FIG. 8 is a bottom view of juicer brush of FIG. 1, in a closed position.

Even when the brush 20 is in the closed position, a space 36 is defined between the first wall 22 and the second wall 26. The space 36 and the angle of the first and second walls 22, 26 enable the brush 20 to fit properly around the wall 12 of the cutter/strainer 10 when in position to clean the cutter/strainer, as shown in FIG. 3.

A plurality of protrusions 30 may be formed on the first wall 22 and/or on the second wall 26. The protrusions 30 help a user securely grip the brush 20 during use. In use, a user will typically grip the top edge of the brush 20 (i.e., where the first wall 22 and the second wall 26 meet), such that the user's thumb applies grasping pressure to the first wall 22 and the user's fingers apply grasping pressure to the second wall 26, or vice versa. Any suitable number, shape, and/or arrangement of protrusions may be used. In FIGS. 1-10, the protrusions are arranged on the lower portions of the outer sides of the first and second walls 22, 26. In other embodiments of the disclosure, the protrusions may be arranged on the upper portions of the first and second walls 22, 26, or across the entirety of the outer sides of the first and second walls 22, 26, or any other suitable arrangement. The plurality of protrusions may be formed of the same material as the first and second walls, may be formed of a different (typically higher friction) material, or may have a coating or top layer made of a different (typically higher friction) material. Any other suitable mechanism may be used to help a user securely grip the cleaning brush during use.

A plurality of frictional cleaning elements 32 project downward from the floor 24 of the brush 20. Additionally, a plurality of frictional cleaning elements 34 project from the first wall 22 toward the second wall 26 (when the second wall is in the closed position) and a plurality of frictional cleaning elements 34 project from the second wall 26 toward the first wall 22 (when the second wall is in the closed position). The frictional cleaning elements 32 would typically (although not necessarily) be arranged such that the entire floor 14 of the cutter/strainer 10 is scrubbed at some point as the brush 20 is rotated around the cutter/strainer 10. Similarly, the frictional cleaning elements 34 would typically (although not necessarily) be arranged such that the entire wall 12, interior and exterior, of the cutter/strainer 10 is scrubbed at some point as the brush 20 is rotated around the cutter/strainer 10.

A plurality of frictional cleaning elements 38 may be arranged at or near the junction of the floor 24 and the first wall 22 (this area may be termed the "transition area," as it is the transition between the floor 24 and the first wall 22), and be angled (downward and backward) to be able to reach the junction of the wall 12 and the floor 14 of the cutter/strainer 10 during cleaning. The frictional cleaning elements 38 arranged at or near the transition area would typically be longer than the other frictional cleaning elements in order to reach the junction of the wall 12 and the floor 14 of the cutter/strainer 10 during cleaning.

The frictional cleaning elements 32, 34, 38 may each comprise a plurality of bristles (the frictional cleaning elements 32, 34, 38 are illustrated as cylinders for simplicity). Any suitable number and arrangement of bristles may be used. For example, the bristles may be arranged in tightly-packed circular groupings of about 50-100 bristles each. The bristles may be grouped together into discrete groupings, or may be generally evenly distributed across the bottom surface of the floor 24 and the opposing surfaces of the first and second walls 22, 26. If in discrete groupings, any suitable number and/or shape of groupings may be used. For example, the bristles may be arranged in straight or curved lines (e.g., radial lines or concentric circles on the floor; parallel lines on the first and second walls), which may be broken or spaced in one or more places or generally continuous. Alternatively, the bristles may be arranged in geometric groupings (e.g., square, rectangular, circular). The bristles may be any suitable length (including having different length bristles in different locations). In one exemplary embodiment of the disclosure, the bristles projecting from the floor are about 7 mm in length, the bristles projecting from the first and second walls are about 7-8 mm in length, and the bristles projecting from the transition area are about 11 mm in length. The bristles may be constructed from any suitable semi-rigid, durable material, such as nylon.

Alternatively, the frictional cleaning elements 32, 34, 38 may comprise a plurality of "squeegee"-type blades or blocks. Any suitable number and/or shape of squeegee blades/blocks may be used. Such squeegee blades/blocks may be constructed of any suitable semi-rigid, durable material, such as rubber or silicon. In another optional embodiment, the frictional cleaning elements 32 may comprise a combination of bristles and squeegee blades/blocks.

The spacing of the first and second walls 22, 26 (i.e., the size of the space 36) and the length of the frictional cleaning elements 34 on the first and second walls 22, 26 may be selected such that the distal ends of the bristles reach about the midpoint between the first and second walls 22, 26 when the brush is in the closed position. Such spacing/length ensures that the bristles contact and apply the desired scrubbing force to both sides of the wall 12 of the cutter/strainer 10. The positions of the frictional cleaning elements 34 on the first and second walls 22, 26 may be selected such that the plurality of frictional cleaning elements projecting from the first wall 22 do not contact any of the plurality of frictional cleaning elements projecting from the second wall 26 when the brush is in the closed position and not in use.

The curvature of the first wall and the second wall generally correspond such that the first and second walls are in a nested-type configuration when the brush is in the closed position (but the first and second walls are not actually in contact with each other, except at the hinge, the projection 44, and possibly other parts of the top edges of the walls). The curvature of the first wall and the second wall generally correspond to the curvature of the sloped mesh wall of the specific cutter/strainer with which the cleaning brush is to be used. The angle of the first wall and the second wall relative to the floor of the cleaning brush generally corresponds to the slope of the sloped mesh wall of the specific cutter/strainer with which the cleaning brush is to be used. In one exemplary embodiment, the angle of the first wall and the second wall relative to the floor of the cleaning brush is about 123°.

Figure 9:
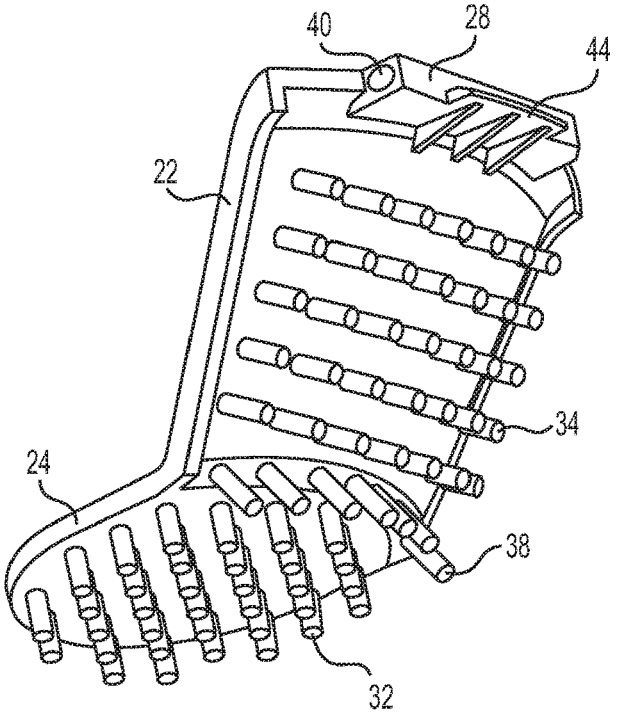
FIG. 9 is a perspective view from the rear/bottom of the front wall and floor of the juicer brush of FIG. 1.
Figure 10:
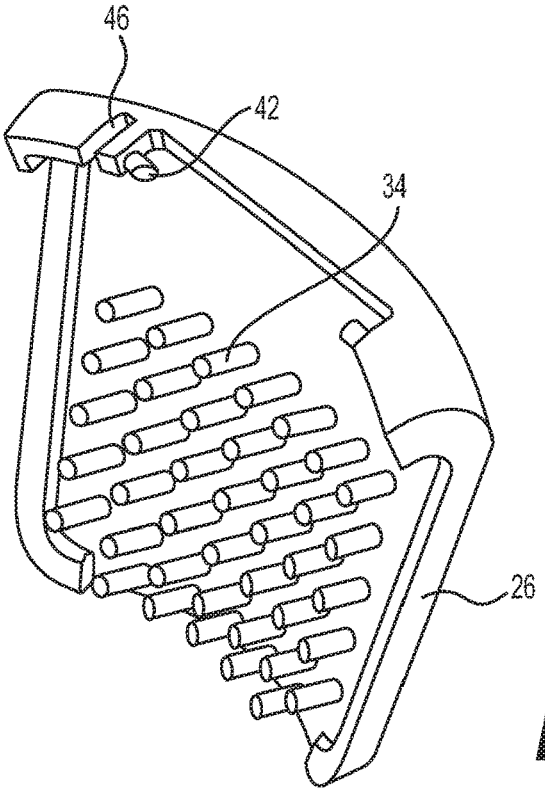
FIG. 10 is a perspective view from the top/front of the rear wall of the juicer brush of FIG. 1.

Referring now to FIGS. 9 and 10, the structure of the hinge 28 is readily seen. The main body of the hinge projects backward from the top edge of the first wall 22. Two holes 40 (only one is visible in FIG. 9) are defined in opposing sides of the main body for receiving hinge posts 42 which are located on opposing sides of a gap in the top edge of the second wall 26. A gap 46 may be defined adjacent one of the hinge posts to enable the adjacent hinge post to move slightly to facilitate insertion of the hinge posts into the holes for joining the first and second walls. Any other suitable hinge mechanism may be used.

A projection 44 from the first wall toward the second wall (or alternatively a projection from the second wall toward the first wall, or both) maintains a desired distance between the first and second walls (i.e., gap 36) when the brush is in the closed position. Any other suitable mechanism may be used for maintaining a desired distance between the first and second walls when the brush is in the closed position.

Figure 2:
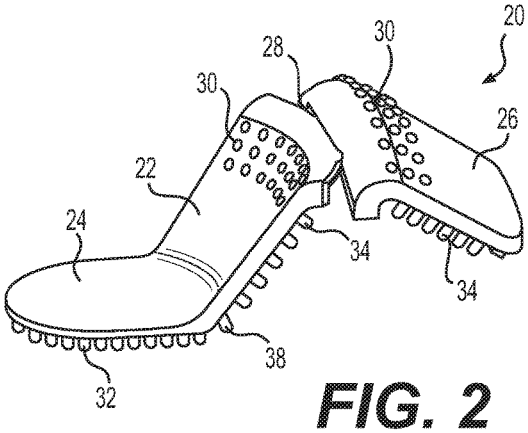
FIG. 2 is a perspective view of the juicer brush of FIG. 1, in at least a partially open position.

In use, the brush 20 is opened by moving the second wall 26 away from the first wall 22, as seen in FIG. 2. The brush 20 is then positioned adjacent a cutter/strainer 10 such that the bristles projecting downward from the floor 24 of the brush 20 contact the floor 14 of the cutter/strainer 10 and such that the bristles projecting from the first wall 22 contact the interior surface of the wall 12 of the cutter/strainer 10. The brush 20 is then closed by moving the second wall toward the first wall 22, resulting in the arrangement shown in FIG. 3. The user grasps the top edge of the brush 20 (i.e., where the first wall 22 and the second wall 26 meet), such that the user's thumb applies grasping pressure to the first wall 22 and the user's fingers apply grasping pressure to the second wall 26, or vice versa. The grasping or squeezing pressure applied by the user's thumb and fingers helps maintain the brush in the closed position (although an optional latching mechanism may also be used to help maintain the brush in the closed position). As the user grasps the brush, the user also applies downward pressure to maintain the bristles of the floor 24 in contact with the floor 14 of the cutter/strainer 10. The user then either holds the brush steady and rotates the cutter/strainer 10 in at least a complete circle, or holds the cutter/strainer 10 steady and rotates the brush in at least a complete circle around the cutter/strainer. The user may move the brush or the cutter/strainer back-and-forth as needed to remove stubborn food particles.

In alternative embodiments of the disclosure (not illustrated), the juicer brush may comprise the first and second walls, with frictional cleaning elements, but the floor of the juicer brush may be omitted. In other alternative embodiments of the disclosure (not illustrated), the juicer brush may comprise the first and second walls, with frictional cleaning elements, but the floor of the juicer brush may not have any frictional cleaning elements.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

That which is claimed:

1. A cleaning brush comprising:

a front curved wall having a front surface and a back surface, a plurality of frictional cleaning elements projecting from the back surface; and a rear curved wall having a front surface and a back surface, a plurality of frictional cleaning elements projecting from the front surface;

wherein the front and rear curved walls are hingedly affixed to each other and movable between an open position and a closed position;

wherein a concavity of the front curved wall and a concavity of the rear curved wall both face in a same direction when the brush is in the closed position;

wherein a convexity of the front curved wall and a convexity of the rear curved wall both face in a same direction when the brush is in the closed position; and a floor affixed to at least a portion of a bottom edge of the front wall, the floor having a top surface and a bottom surface and a plurality of frictional cleaning elements projecting from the bottom surface.

2. The cleaning brush of claim 1, wherein the plurality of frictional cleaning elements protrude substantially perpendicularly from the back surface of the front wall;

wherein the plurality of frictional cleaning elements protrude substantially perpendicularly from the front surface of the back wall; and wherein the plurality of frictional cleaning elements protrude substantially perpendicularly from the bottom surface of the floor.

3. The cleaning brush of claim 1, wherein the plurality of frictional cleaning elements projecting from the back surface of the front wall each comprise a plurality of bristles;

wherein the plurality of frictional cleaning elements projecting from the front surface of the back wall each comprise a plurality of bristles; and wherein the plurality of frictional cleaning elements projecting from the bottom surface of the floor each comprise a plurality of bristles.

4. The cleaning brush of claim 1, further comprising a plurality of frictional cleaning elements projecting along a junction between the bottom surface of the floor and the back surface of the front wall.

5. The cleaning brush of claim 4, wherein the plurality of frictional cleaning elements projecting along a junction between the bottom surface of the floor and the back surface of the front wall each comprise a plurality of bristles.

6. The cleaning brush of claim 1, wherein the front and rear curved walls are hingedly affixed to each other at a respective top edge of each.

7. The cleaning brush of claim 1, wherein the plurality of frictional cleaning elements projecting from the back surface of the front wall and the plurality of frictional cleaning elements projecting from the front surface of the back wall are positioned such that the plurality of frictional cleaning elements projecting from the back surface of the front wall do not contact any of the plurality of frictional cleaning elements projecting from the front surface of the back wall when the brush is in the closed position.

8. A cleaning brush comprising:

a front curved wall having a front surface and a back surface, a plurality of frictional cleaning elements projecting from the back surface; and a rear curved wall having a front surface and a back surface, a plurality of frictional cleaning elements projecting from the front surface;

wherein the front and rear curved walls are hingedly affixed to each other and movable between an open position and a closed position;

a plurality of raised protrusions on the front surface of the front wall and a plurality of raised protrusions on the back surface of the back walk;

wherein a concavity of the front curved wall and a concavity of the rear curved wall both face in a same direction when the brush is in the closed position; and wherein a convexity of the front curved wall and a convexity of the rear curved wall both face in a same direction when the brush is in the closed position.

9. A cleaning brush comprising:

a front curved wall having a front surface and a back surface, a plurality of frictional cleaning elements projecting from the back surface; and a rear curved wall having a front surface and a back surface, a plurality of frictional cleaning elements projecting from the front surface;

wherein the front and rear curved walls are hingedly affixed to each other and movable between an open position and a closed position;

a projection from the front wall toward the back wall or a projection from the back wall toward the front wall or both to maintain a desired distance between the front and back walls when the brush is in the closed position;

wherein a concavity of the front curved wall and a concavity of the rear curved wall both face in a same direction when the brush is in the closed position; and wherein a convexity of the front curved wall and a convexity of the rear curved wall both face in a same direction when the brush is in the closed position.

10. A method of cleaning a cutter/strainer of a centrifugal juicer, the cutter/strainer having a sloped wall and a circular floor, the method comprising:

obtaining a cleaning brush comprising:

a front curved wall having a front surface and a back surface, a plurality of frictional cleaning elements projecting from the back surface;

a rear curved wall having a front surface and a back surface, a plurality of frictional cleaning elements projecting from the front surface; and a floor affixed to at least a portion of a bottom edge of the front wall, the floor having a top surface and a bottom surface and a plurality of frictional cleaning elements projecting from the bottom surface;

wherein the front and rear curved walls are hingedly affixed to each other and movable between an open position and a closed position;

wherein a concavity of the front curved wall and a concavity of the rear curved wall both face in a same direction when the brush is in the closed position; and wherein a convexity of the front curved wall and a convexity of the rear curved wall both face in a same direction when the brush is in the closed position;

with the brush in the open position, position the brush relative to the cutter/strainer such that the plurality of frictional cleaning elements projecting from the bottom surface of the floor contact a top surface of the floor of the cutter/strainer and such that the plurality of frictional cleaning elements projecting from the back surface of the front wall contact an inner surface of the sloped wall of the cutter/strainer;

moving the back wall to the closed position such that the plurality of frictional cleaning elements projecting from the front surface of the back wall contact an outer surface of the sloped wall of the cutter/strainer; and while applying a clamping force to the front and back walls of the brush and applying a downward force to the floor of the brush, moving the brush along the sloped wall of the cutter/strainer.

11. The method of claim 10, wherein the plurality of frictional cleaning elements protrude substantially perpendicularly from the back surface of the front wall;

wherein the plurality of frictional cleaning elements protrude substantially perpendicularly from the front surface of the back wall; and wherein the plurality of frictional cleaning elements protrude substantially perpendicularly from the bottom surface of the floor.

12. The method of claim 10, wherein the plurality of frictional cleaning elements projecting from the back surface of the front wall each comprise a plurality of bristles;

wherein the plurality of frictional cleaning elements projecting from the front surface of the back wall each comprise a plurality of bristles; and wherein the plurality of frictional cleaning elements projecting from the bottom surface of the floor each comprise a plurality of bristles.

13. The method of claim 10, wherein the cleaning brush further comprises a plurality of frictional cleaning elements projecting along a junction between the bottom surface of the floor and the back surface of the front wall.

14. The method of claim 13, wherein the plurality of frictional cleaning elements projecting along a junction between the bottom surface of the floor and the back surface of the front wall each comprise a plurality of bristles.

15. The method of claim 10, wherein the front and rear curved walls are hingedly affixed to each other at a respective top edge of each.

16. The method of claim 10, wherein the cleaning brush further comprises a plurality of raised protrusions on the front surface of the front wall and a plurality of raised protrusions on the back surface of the back wall.

17. The method of claim 10, wherein the cleaning brush further comprises either a projection from the front wall toward the back wall or a projection from the back wall toward the front wall to maintain a desired distance between the front and back walls when the brush is in the closed position.

18. The method of claim 10, wherein the plurality of frictional cleaning elements projecting from the back surface of the front wall and the plurality of frictional cleaning elements projecting from the front surface of the back wall are positioned such that the plurality of frictional cleaning elements projecting from the back surface of the front wall do not contact any of the plurality of frictional cleaning elements projecting from the front surface of the back wall when the brush is in the closed position.

* * * * *